US005447186A

United States Patent [19]

Achard et al.

[11] Patent Number: 5,447,186

[45] Date of Patent: Sep. 5, 1995

[54] CHIPPING CANTER

[75] Inventors: René Achard, Montréal; Eddy Ste-Croix, Lanoraie, both of Canada

[73] Assignee: Sawquip International, Inc., Québec, Canada

[21] Appl. No.: 170,148

[22] Filed: Dec. 20, 1993

[51] Int. Cl.[6] ..... B27B 1/00; B27C 1/08

[52] U.S. Cl. ..... 144/357; 144/3 R; 144/117 R; 144/246 R; 144/246 F; 144/246 G; 144/370; 144/373; 144/116

[58] Field of Search ..... 144/3 R, 3 P, 114 R, 144/39, 41, 116, 117 R, 162 R, 176, 356, 357, 369, 370, 373

[56] References Cited

U.S. PATENT DOCUMENTS

| | | | |
|---|---|---|---|
| 2,102,186 | 12/1937 | Nicholson et al. | 144/116 |
| 2,859,780 | 11/1958 | Carlson | 144/116 |
| 3,313,329 | 4/1967 | Mitten | 144/373 |
| 3,326,252 | 6/1967 | Pease | 144/3 |
| 3,373,782 | 3/1968 | Pease . | |
| 3,960,041 | 6/1976 | Warren et al. | 144/387 |
| 4,077,448 | 3/1978 | Hasenwinkle et al. | 144/373 |
| 4,457,350 | 7/1984 | Finnila | 144/117 R |
| 4,570,687 | 2/1986 | Dietz | 144/378 |
| 4,879,659 | 11/1989 | Bowlin et al. | 144/357 |
| 4,881,584 | 11/1989 | Wislocker et al. | 144/39 |
| 4,907,632 | 3/1990 | Reuter | 144/357 |

FOREIGN PATENT DOCUMENTS

| | | |
|---|---|---|
| 874790 | 7/1971 | Canada . |
| 942635 | 2/1974 | Canada . |
| 1131551 | 9/1982 | Canada . |
| 1146052 | 5/1983 | Canada . |
| 1157349 | 11/1983 | Canada . |
| 1204984 | 5/1986 | Canada . |
| 1218581 | 3/1987 | Canada . |

*Primary Examiner*—W. Donald Bray
*Attorney, Agent, or Firm*—Galgano & Burke

[57] ABSTRACT

A chipping canter is provided for producing four-sided cants from curved logs. It allows the slabbing heads thereof to follow the natural curvature of the logs for obtaining cants having a maximum cross-sectional area and length. Each log is flatly disposed on a log deck and is scanned at the entry for obtaining information about the curvature and dimensions thereof, and then calculating the position of the log deck and of the centering rollers. As the log is forwarded along the path in the chipping canter, the log is always properly aligned with respect to the slabbing heads.

11 Claims, 14 Drawing Sheets

SEE FIG. 1D
SEE FIG. 1C
SEE FIG. 1B
SEE FIG. 1A 10
12
14
30
34
36
36
70
72
74
75
76
80
81
84
85
86
86
87
87
88
88
90
92
94
95
96
100
100
200
300
400
500

CHIPPING CANTER

FIELD OF THE INVENTION

The present invention relates to a chipping canter for producing a four-sided cant from a curved log.

BACKGROUND OF THE INVENTION

It is well known that timbers in the forests almost never grow perfectly straight. Each timber has its own specific shape which is the result of small natural curvatures of the trunk along its length. These curvatures create a resulting curvature hereinafter called "the curvature" which may be small or negligible on most timbers but very important on many others. While most of the curvatures are the results of nature, some may also be the result of bad transportation or storage conditions.

Once the timbers are cut down, many of the resulting logs are used by the sawmill industry for transforming them into studs, beams or similar products. The logs are first brought to a location called the cant mill which may be in the sawmill itself or not. The logs are then transformed into cants by a chipping canter upon removal of outside wood portions on usually four sides with slabbing heads for obtaining cants with rectangular cross-sections. The slabbing heads transform these wood portions into wood chips and dust, which can later be used for other purposes, particularly for producing wood pulp.

In the past, the curvature of the logs was not an important factor because the timbers were generally old growth trees bigger than the ones found nowadays. The curved portions were then simply machined off and the resulting straight cants were still having a very large cross-sectional area and a very suitable length. As the timbers become smaller and the operating costs higher particularly because of the remote locations of modern logging sites, the systematic rejection of small curved timbers is no longer possible. Curved sawing techniques are now increasingly used by the sawmill industry for producing studs and beams from curved cants. The curved studs or beams are straightened thereafter by a suitable process.

In spite of the increasing economical value of curved logs, no suitable chipping canter has yet been developed for optimally machining those curved logs.

SUMMARY OF THE INVENTION

The object of the present invention is to provide a chipping canter which maximizes the cross-sectional area and length by machining the logs according to their curvature.

More particularly, the object of the present invention is to provide a chipping canter for producing a four-sided cant from a log having a curvature, the chipping canter having an entry and an exit between which is defined a log path, the chipping canter comprising:

driving means for forwarding the log along the log path;

conveyor means having a supporting surface for supporting the log flatly disposed thereon, the supporting surface having an input end and an output end, the conveyor means being located at the entry and comprising first displacement means for vertically moving at least one of the ends;

scanning means located at the input end of the supporting surface for producing first signals indicative of the curvature and dimensions of the log;

first positioning means adjacent the output end of the supporting surface;

second positioning means located downstream the first positioning means and movable substantially laterally with respect to a longitudinal axis of the chipping canter by second displacement means;

a first slabbing head assembly for producing a first machined side, the first slabbing head assembly comprising a first slabbing head substantially horizontally disposed;

third positioning means located downstream the second positioning means;

a second slabbing head assembly for producing a second machined side, the second slabbing head assembly comprising a second slabbing head substantially vertically disposed and movable substantially perpendicularly with respect to the longitudinal axis of the chipping canter by third displacement means, the second slabbing head being located downstream the third positioning means;

a third slabbing head assembly for producing a third machined side opposite the second machined side, the third slabbing head assembly comprising a third slabbing head substantially vertically disposed and movable substantially perpendicularly with respect to the longitudinal axis of the chipping canter by fourth displacement means, the third slabbing head being located downstream the third positioning means;

a fourth slabbing head assembly for producing a second substantially horizontal machined side opposite the first machined side, the fourth slabbing head assembly comprising a fourth slabbing head substantially horizontally disposed;

fourth positioning means adjacent to the exit;

fifth positioning means located downstream the fourth positioning means; and computer means for receiving the first signals from the scanning means and producing second signals for controlling the driving means, the displacement means and the positioning means;

whereby, as the log is forwarded along the log path, the conveyor means and the positioning means are properly aligning the log with respect to the slabbing heads.

According to a preferred embodiment, the fourth slabbing head is movable substantially perpendicularly with respect to the longitudinal axis of the chipping canter by fifth displacement means.

According to another preferred embodiment, the first displacement means comprise actuators for moving independently each of the ends of the conveyor means.

According to a still preferred embodiment, the second and third slabbing heads are substantially coaxial.

According to a still preferred embodiment, the signals produced by the computer means are sent to the second displacement means before the log is detected by first sensing means, preferably a photodetector, adjacent the first positioning means.

According to a still preferred embodiment, each of the positioning means comprises two centring rollers pneumatically actuated, each roller comprising a plurality of spikes radially projecting therefrom.

According to a still preferred embodiment, each of the positioning means comprises centring means for symmetrically moving each of the corresponding two centring rollers about the log path.

According to a still preferred embodiment, the supporting surface is a belt, the driving means comprising a hydraulic motor for driving the belt and a plurality of hydraulic motors for driving the centring rollers.

According to a still preferred embodiment, the second displacement means comprise a carriage hydraulically actuated.

It is also an object of the present invention to provide a method for operating a chipping canter for producing a four-sided cant from a log having curvature, the chipping canter having an entry and an exit between which is defined a log path along which the log is forwarded, the method comprising the steps of:

flatly disposing the log on a supporting surface of conveyor means, the supporting surface having an input end and an output end, the conveyor means being located at the entry and comprising first displacement means for vertically moving at least one of the ends;

scanning the log with scanning means located at the input end of the supporting surface for producing first signals indicative of the curvature and dimensions of the log;

receiving the first signals and producing second signals with computer means;

vertically moving at least one of the ends of the conveyor means according to the second signals;

positioning the log with first positioning means adjacent the output end of the supporting surface;

positioning the log with second positioning means located downstream the first positioning means and movable substantially perpendicularly with respect to a longitudinal axis of the chipping canter by second displacement means responsive to the second signals;

producing a first machined side with a first slabbing head assembly, the first slabbing head assembly comprising a first slabbing head substantially horizontally disposed;

positioning the log with third positioning means located downstream the second positioning means;

producing a second machined side with a second slabbing head assembly, the second slabbing head assembly comprising a second slabbing head substantially vertically disposed and movable substantially perpendicularly with respect to the longitudinal axis of the chipping canter by third displacement means responsive to the second signals, the second slabbing head being located downstream the third positioning means;

producing a third machined side opposite to the second machined side with a third slabbing head assembly, the third slabbing head assembly comprising a third slabbing head substantially vertically disposed and movable substantially perpendicularly with respect to the longitudinal axis of the chipping canter by fourth displacement means, the third slabbing head being located downstream the third positioning means responsive to the second signals;

producing a second substantially horizontal machined side opposite the first machined side with a fourth slabbing head assembly, the fourth slabbing head assembly comprising a fourth slabbing head substantially horizontally disposed;

positioning the log with fourth positioning means adjacent to the exit;

positioning the log with fifth positioning means located downstream the fourth positioning means;

whereby, as the log is forwarded along the log path, the positioning means are properly aligning the log with respect to the slabbing heads.

A non restrictive description of a preferred embodiment will now be given with reference to the appended drawings.

Figure 2:
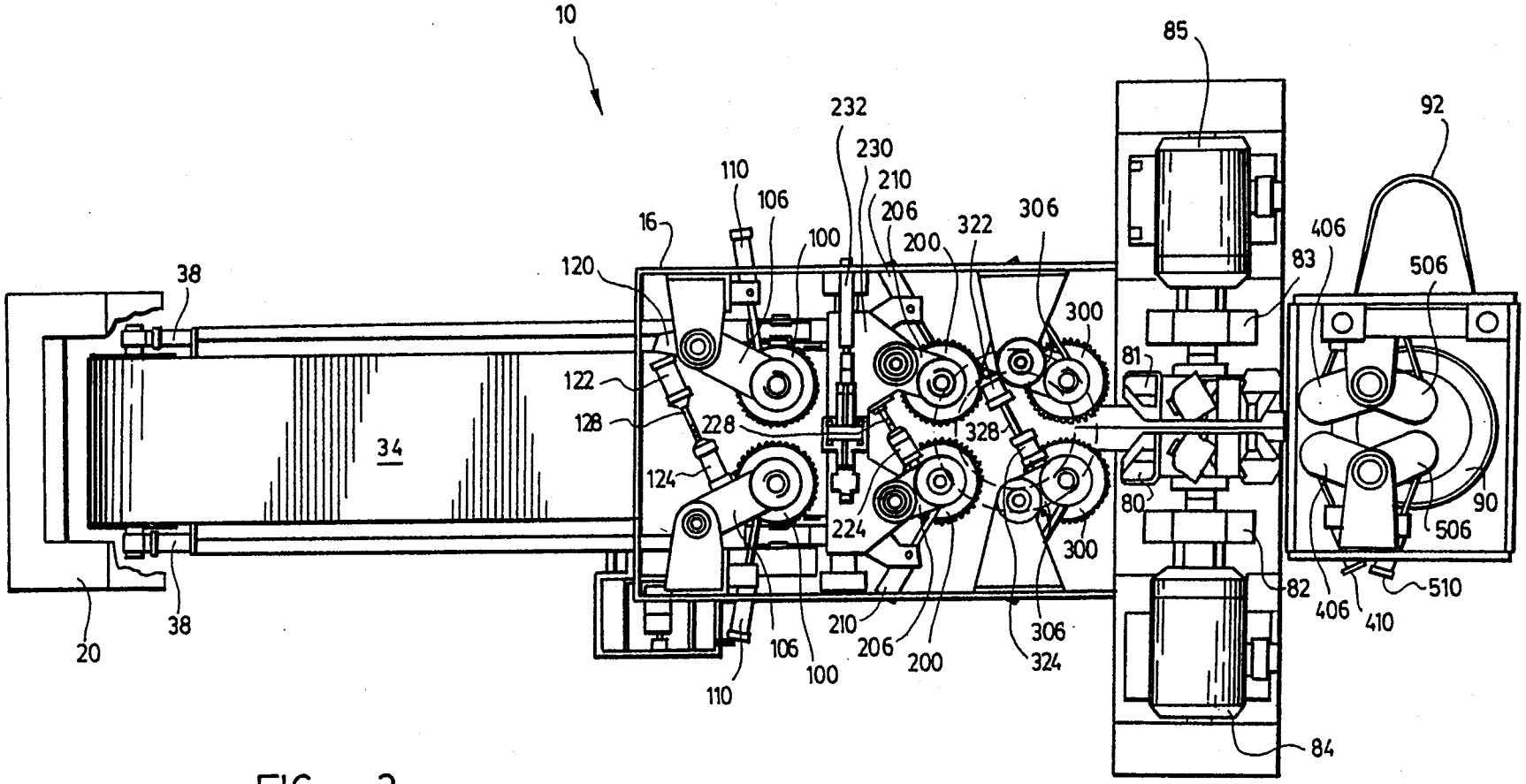
FIG. 2 is an upper elevational view of the chipping canter according to the present invention.
Figure 10:
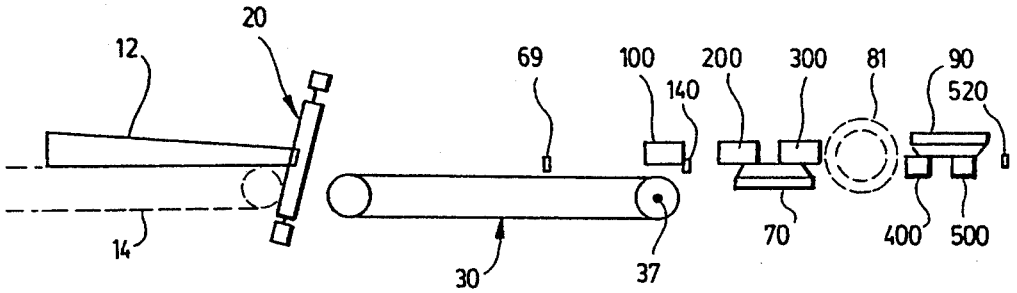
Figure 11:
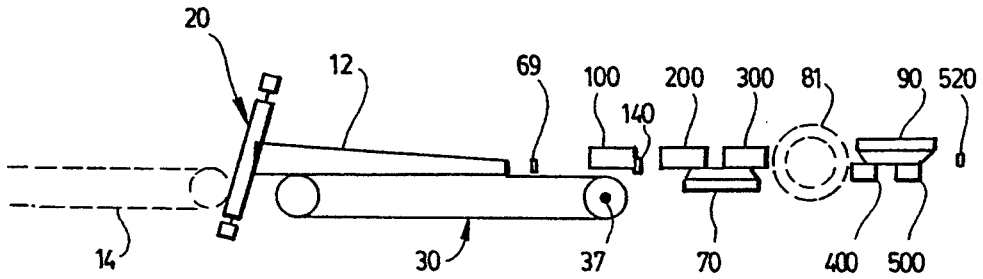
Figure 12:
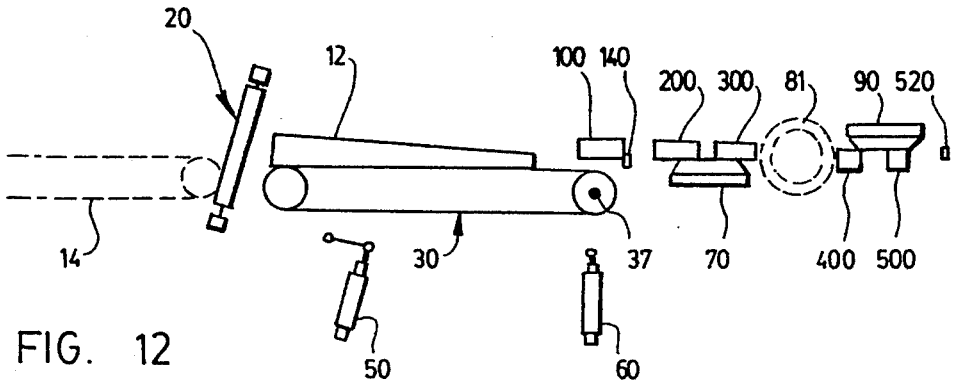
Figure 13:
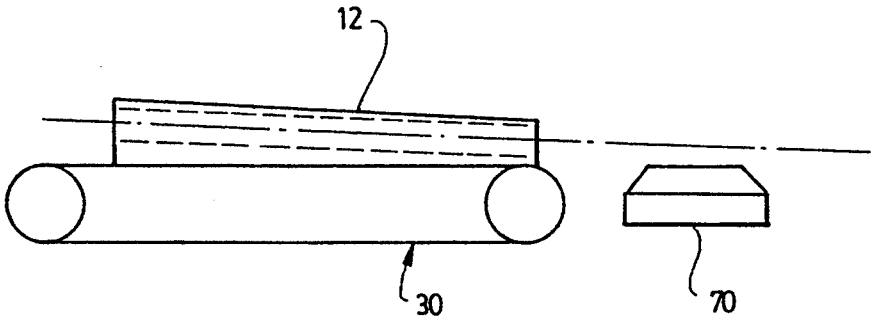
Figure 14:
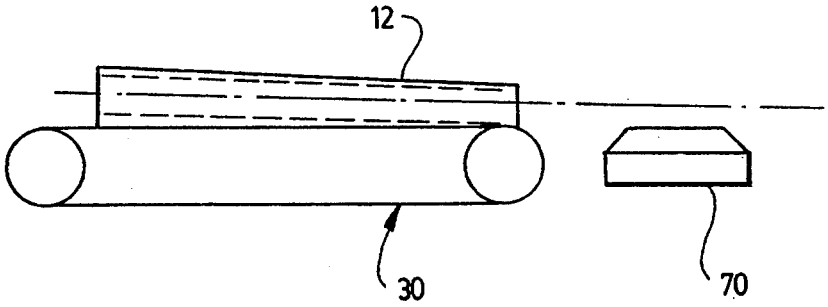
Figure 15:
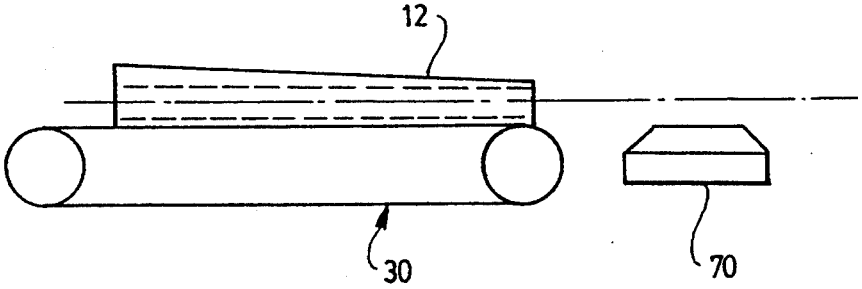
Figure 16:
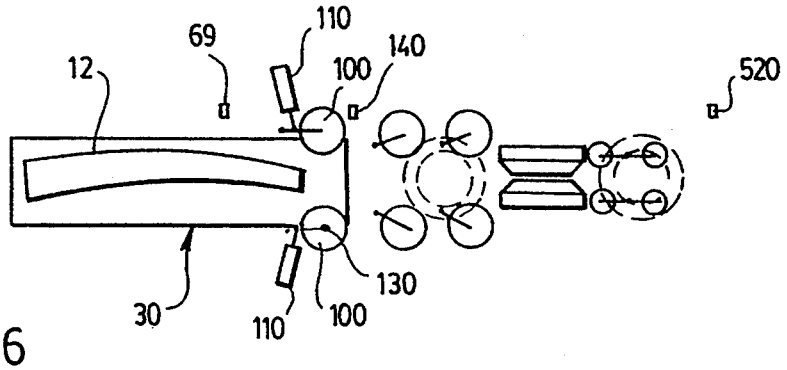
Figure 17:
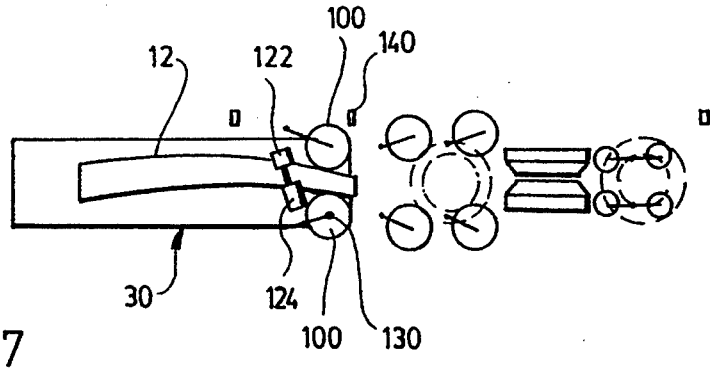
Figure 18:
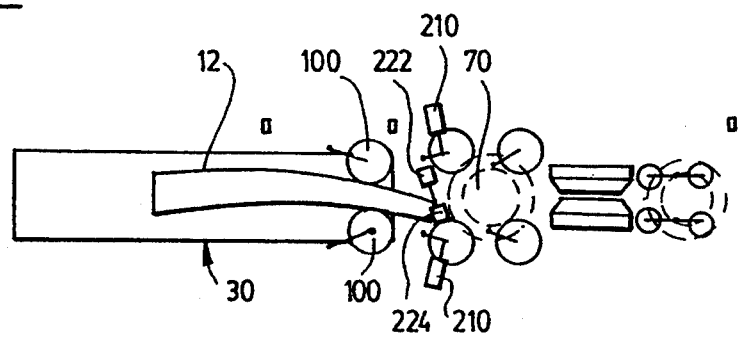
Figure 19:
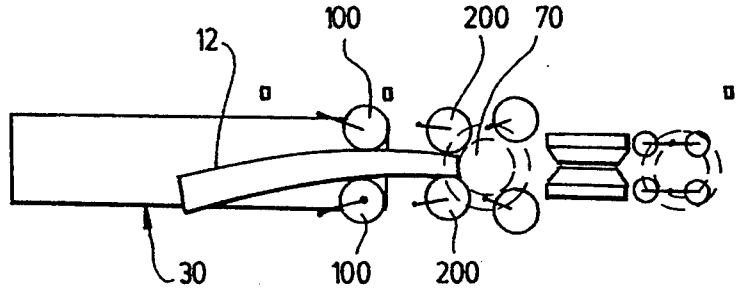
Figure 20:
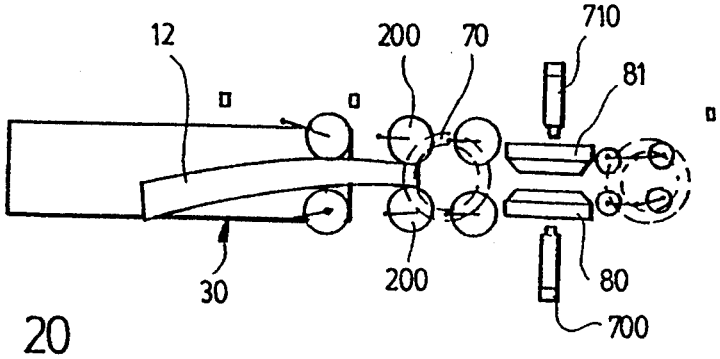
Figure 21:
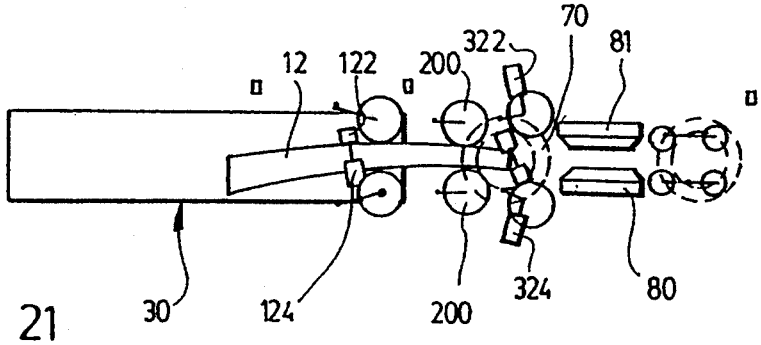
Figure 22:
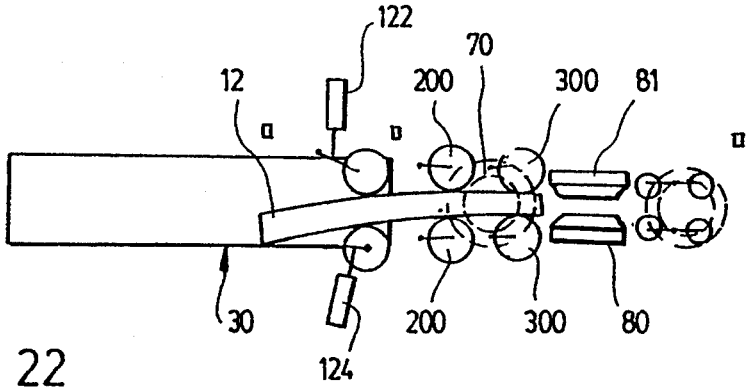
Figure 23:
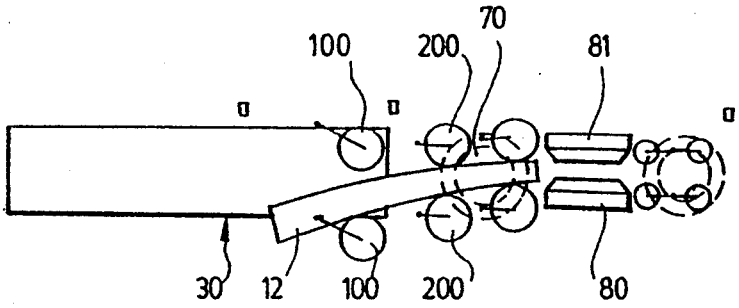
Figure 24:
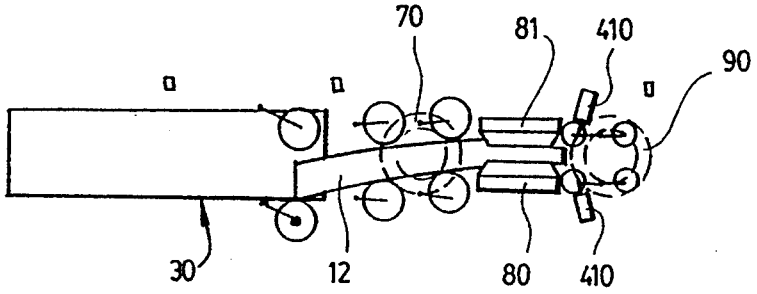
Figure 25:
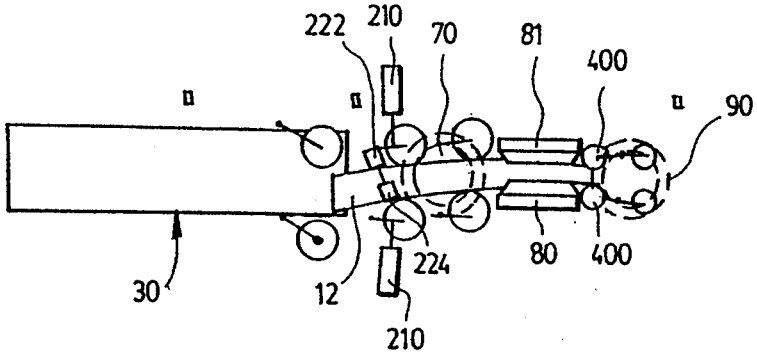
Figure 26:
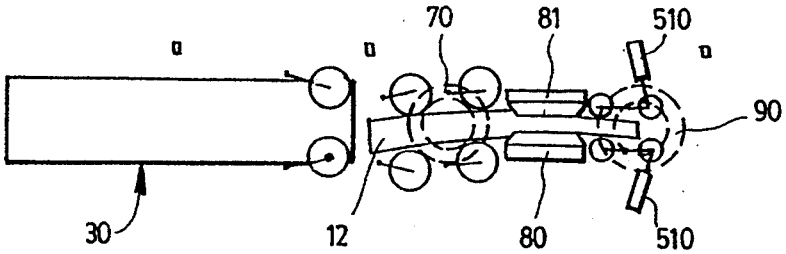
Figure 27:
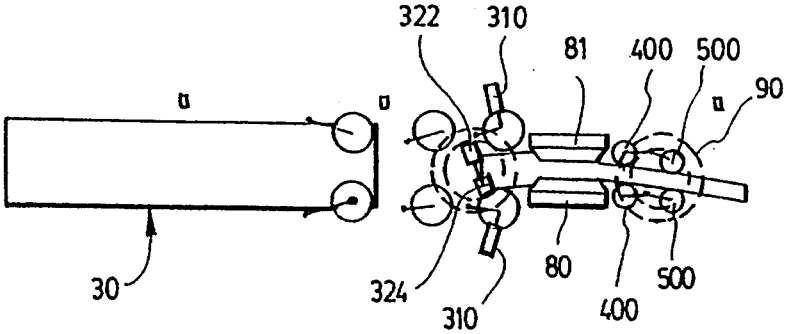
Figure 28:
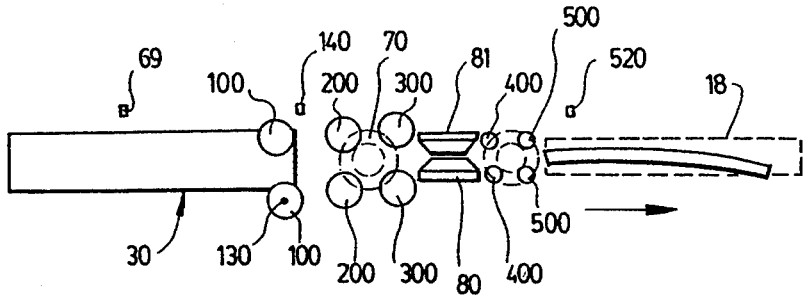
Figure 29:
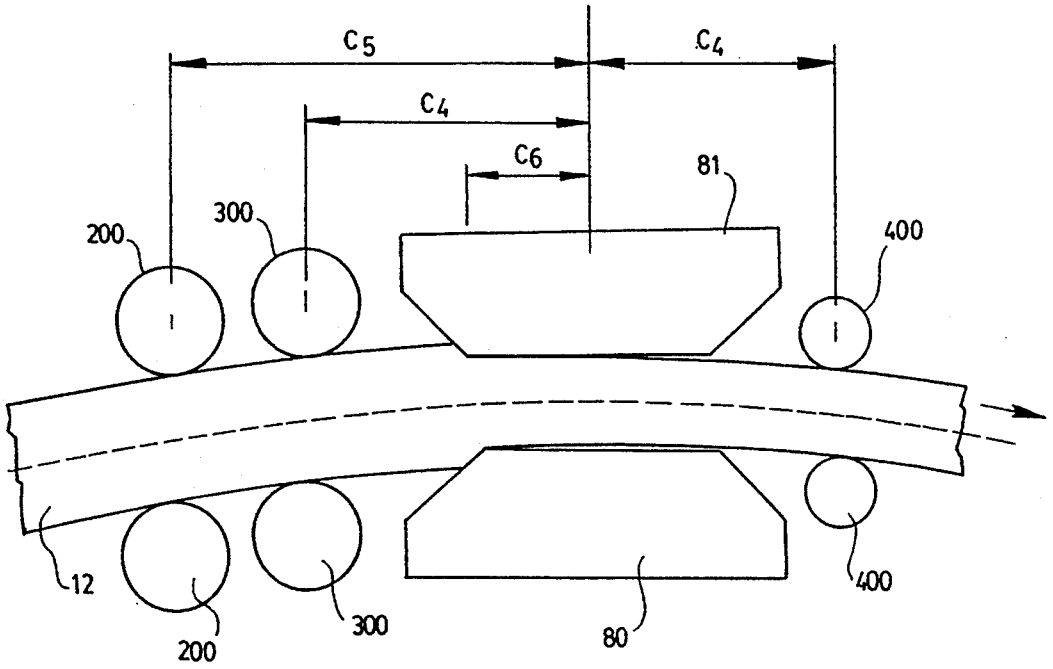

FIGS. **9*a* and 9*b*** are schematic views showing examples of cutting patterns according to the present invention;

FIG. **9*c*** is a schematic view showing an example of a cutting pattern according to the prior art;

FIG. 10 is a schematic side view of the chipping canter of FIG. 2, showing the log at a position prior to being scanned;

FIG. 11 is a schematic side view of the chipping canter of FIG. 2, showing the log on the positioning conveyor;

FIG. 12 is a schematic side view of the chipping canter of FIG. 2, showing the positioning conveyor being set to the entry position;

FIG. 13 is a schematic diagram showing a badly oriented positioning conveyor;

FIG. 14 is a schematic diagram similar to the one of FIG. 13 and showing a positioning conveyor with a suitable orientation;

FIG. 15 is a schematic diagram similar to the one of FIG. 13 and showing a badly oriented positioning conveyor;

FIG. 16 is a schematic upper view of the chipping canter of FIG. 2, showing the log with its forward end near the first positioning rollers;

FIG. 17 is a schematic upper view of the chipping canter of FIG. 2, showing the log with its forward end between the first positioning rollers;

FIG. 18 is a schematic upper view of the chipping canter of FIG. 2, showing the log with its forward end near the second positioning rollers;

FIG. 19 is a schematic upper view of the chipping canter of FIG. 2, showing the log with its forward end between the second positioning rollers and over the first slabbing head;

FIG. 20 is a schematic upper view of the chipping canter of FIG. 2, showing the second and third slabbing heads being positioned;

FIG. 21 is a schematic upper view of the chipping canter of FIG. 2, showing the log with its forward end near the third positioning rollers;

FIG. 22 is a schematic upper view of the chipping canter of FIG. 2, showing the log with its forward end between the third positioning rollers, and showing the first positioning means being released;

FIG. 23 is a schematic upper view of the chipping canter of FIG. 2, showing the log moved over the conveyor;

FIG. 24 is a schematic upper view of the chipping canter of FIG. 2, showing the log with its forward end being cut by the second and third slabbing heads, and near the fourth positioning rollers;

FIG. 25 is a schematic upper view of the chipping canter of FIG. 2, showing the log with its forward end between the fourth positioning rollers and near the fifth positioning rollers;

FIG. 26 is a schematic upper view of the chipping canter of FIG. 2, showing the log with its forward end near the fifth positioning rollers;

FIG. 27 is a schematic upper view of the chipping canter of FIG. 2, showing the log with its forward end between the fifth positioning rollers, and showing the third positioning means being released;

FIG. 28 is a schematic upper view of the chipping canter of FIG. 2, showing the log at the end of the process; and FIG. 29 is a schematic enlarged view of log being machined by the lateral slabbing heads.

IDENTIFICATION OF THE COMPONENTS

The following is a list of each reference numeral in the drawings along with the name of the corresponding components. This list refers to the preferred embodiment illustrated in the drawings and should not be interpreted as restricting the scope or spirit of the invention.

Summary of the reference numerals:

A–D: relating to the log cross-section

1–99: relating to general components

100–199: relating to first positioning means

200–299: relating to second positioning means

300–399: relating to third positioning means

400–499: relating to fourth positioning means

500–599: relating to fifth positioning means

600–699: relating to hydraulic components

700–799: relating to slabbing head moving components

800–899: relating to computer means

In detail:

| | |
|---|---|
| A | initial log cross-section |
| B | log cross-section with a lower machined side |
| C | log cross-section of B with a second and a third machined side |
| D | log cross-section of C with an upper machined side |
| 10 | chipping canter |
| 12 | log |
| 14 | feeding conveyor |
| 16 | main frame |
| 18 | exit conveyor |
| 20 | entry scanner assembly |
| 22 | horizontal upper scanner |
| 24 | horizontal lower scanner |
| 26 | vertical left scanner |
| 28 | vertical right scanner |
| 30 | log deck |
| 32 | log deck upper frame |
| 33 | log deck lower frame |
| 34 | belt |
| 36 | belt pulleys (2) |

-continued

| | |
|---|---|
| 37 | position encoder |
| 38 | belt tighteners (2) |
| 40 | hydraulic motor |
| 41 | belt guard |
| 42 | lever |
| 44 | first pivot |
| 46 | second pivot |
| 47 | hydraulic control valve (for hyd. motor 40) |
| 50 | upstream hydraulic actuator |
| 52 | lower attachment pivot (for upstream hyd. actuator 50) |
| 56 | hydraulic control valve (for upstream hyd. actuator 50) |
| 58 | position gauge (for upstream hyd. actuator 50) |
| 60 | downstream hydraulic actuator |
| 62 | lower attachment pivot (for downst. hyd. actuator 60) |
| 64 | upper attachment pivot (for downst. hyd. actuator 60) |
| 66 | hydraulic control valve (for downst. hyd. actuator 60) |
| 68 | position gauge (for downst. hyd. actuator 60) |
| 69 | entry photodetector |
| 70 | lower slabbing head |
| 71 | support (for lower slabbing head 70) |
| 72 | electrical motor (for lower slabbing head 70) |
| 74 | belt (for lower slabbing head 70) |
| 75 | pulley (for lower slabbing head 70) |
| 76 | shaft (for lower slabbing head 70) |
| 80 | right lateral slabbing head |
| 81 | left lateral slabbing head |
| 82 | support (for right lateral slabbing head 80) |
| 83 | support (for left lateral slabbing head 81) |
| 84 | electrical motor (for right lateral slabbing head 80) |
| 85 | electrical motor (for left lateral slabbing head 81) |
| 86 | belts (2) (for both lateral slabbing heads 80 and 81) |
| 87 | pulleys (2) (for both lateral slabbing heads 80 and 81) |
| 88 | shafts (2) (for both lateral slabbing heads 80 and 81) |
| 90 | upper slabbing head |
| 91 | support (for upper slabbing head 90) |
| 92 | electrical motor (for upper slabbing head 90) |
| 94 | belt (for upper slabbing head 90) |
| 95 | pulley (for upper slabbing head 90) |
| 96 | shaft (for upper slabbing head 90) |
| 100 | first centring rollers (2) |
| 102 | hydraulic motors (2) (for first centring rollers 100) |
| 104 | hydraulic control valve (for both hyd. motors 102) |
| 106 | pressing arms (2) |
| 110 | pneumatic actuators (2) |
| 112 | pneumatic control valve (for both pneum. actuators 110) |
| 120 | extension (for one of pressing arms 106) |
| 122 | left pneumatic self-centring actuator |
| 124 | right pneumatic self-centring actuator |
| 126 | pneumatic control valve (for both pneum. self-centring actuators 122 and 124) |
| 128 | rod (for pneumatic self-centring actuators 122 and 124) |
| 130 | position encoder |
| 140 | intermediate photodetector |
| 200 | second centring rollers (2) |
| 202 | hydraulic motors (2) (for second centring rollers 200) |
| 204 | hydraulic control valve (for both hyd. motors 202) |
| 206 | pressing arms (2) |
| 210 | pneumatic actuators (2) |
| 212 | pneumatic control valve (for both pneum. actuators 210) |
| 222 | left pneumatic self-centring actuator |
| 224 | right pneumatic self-centring actuator |
| 226 | pneumatic control valve (for both pneum. self-centring actuators 222 and 224) |
| 228 | rod (for pneumatic self-centring actuators 222 and 224) |
| 230 | laterally movable carriage (for second centring rollers 200) |
| 232 | hydraulic actuator (for laterally movable carriage 230) |
| 234 | hydraulic control valve (for hyd. actuator 232) |
| 236 | position gauge (for hyd. actuator 232) |
| 300 | third centring rollers (2) |
| 302 | hydraulic motors (2) (for third centring rollers 300) |
| 304 | hydraulic control valve (for both hyd. motors 302) |
| 306 | pressing arms (2) |
| 310 | pneumatic actuators (2) |
| 312 | pneumatic control valve (for both pneum. actuators 310) |
| 320 | extension (for one of pressing arms 306) |
| 322 | left pneumatic self-centring actuator |
| 324 | right pneumatic self-centring actuator |
| 326 | pneumatic control valve (for both pneum. self-centring actuators 322 and 324) |
| 328 | rod (for pneumatic self-centring actuators 322 and 324) |
| 400 | fourth centring rollers (2) |

-continued

| | |
|---|---|
| 402 | hydraulic motors (2) (for fourth centring rollers 400) |
| 404 | hydraulic control valve (for both hyd. motors 402) |
| 406 | pressing arms (2) |
| 410 | pneumatic actuators (2) |
| 412 | pneumatic control valve (for both pneum. actuators 410) |
| 500 | fifth centring rollers (2) |
| 502 | hydraulic motors (2) (for fourth centring rollers 500) |
| 504 | hydraulic control valve (for both hyd. motors 502) |
| 506 | pressing arms (2) |
| 510 | pneumatic actuators (2) |
| 512 | pneumatic control valve (for both pneum. actuators 510) |
| 520 | exit photodetector |
| 600 | hydraulic pump (for first actuators group) |
| 602 | electric motor (for hyd. pump 600) |
| 610 | hydraulic pump (for second actuators group) |
| 612 | electric motor (for hyd. pump 610) |
| 620 | hydraulic fluid tank (for both actuators groups) |
| 630 | hydraulic pump (for first hyd. motors group) |
| 632 | electric motor (for hyd. pump 630) |
| 634 | hydraulic pump (for second hyd. motors group) |
| 636 | electric motor (for hyd. pump 634) |
| 640 | hydraulic fluid tank (for both motors groups) |
| 650 | first service hydraulic actuator |
| 652 | manual hydraulic control valve (for hyd. actuator 650) |
| 654 | second service hydraulic actuator |
| 656 | manual hydraulic control valve (for hyd. actuator 654) |
| 700 | right hydraulic actuator (for moving right lateral slabbing head assembly 80) |
| 702 | hydraulic control valve (for right hyd. actuator 700) |
| 704 | position gauge (for right hyd. actuator 700) |
| 710 | left hydraulic actuator (for moving left lateral slabbing head assembly 81) |
| 712 | hydraulic control valve (for left hyd. actuator 710) |
| 714 | position gauge (for left hyd. actuator 710) |
| 720 | upper hydraulic actuator (for moving upper slabbing head) |
| 722 | hydraulic control valve (for upper hyd. actuator 720) |
| 724 | position gauge (for upper hyd. actuator 720) |
| 800 | computer |
| 802 | keyboard |
| 804 | printer |
| 806 | monitor |
| 810 | chipping canter controls (2) |
| 812 | monitor |
| 814 | connection boxes (4) |
| 820 | electrical relay box |

DESCRIPTION OF A PREFERRED EMBODIMENT

Figures 1, 1A, 1B, 1C, 1D:
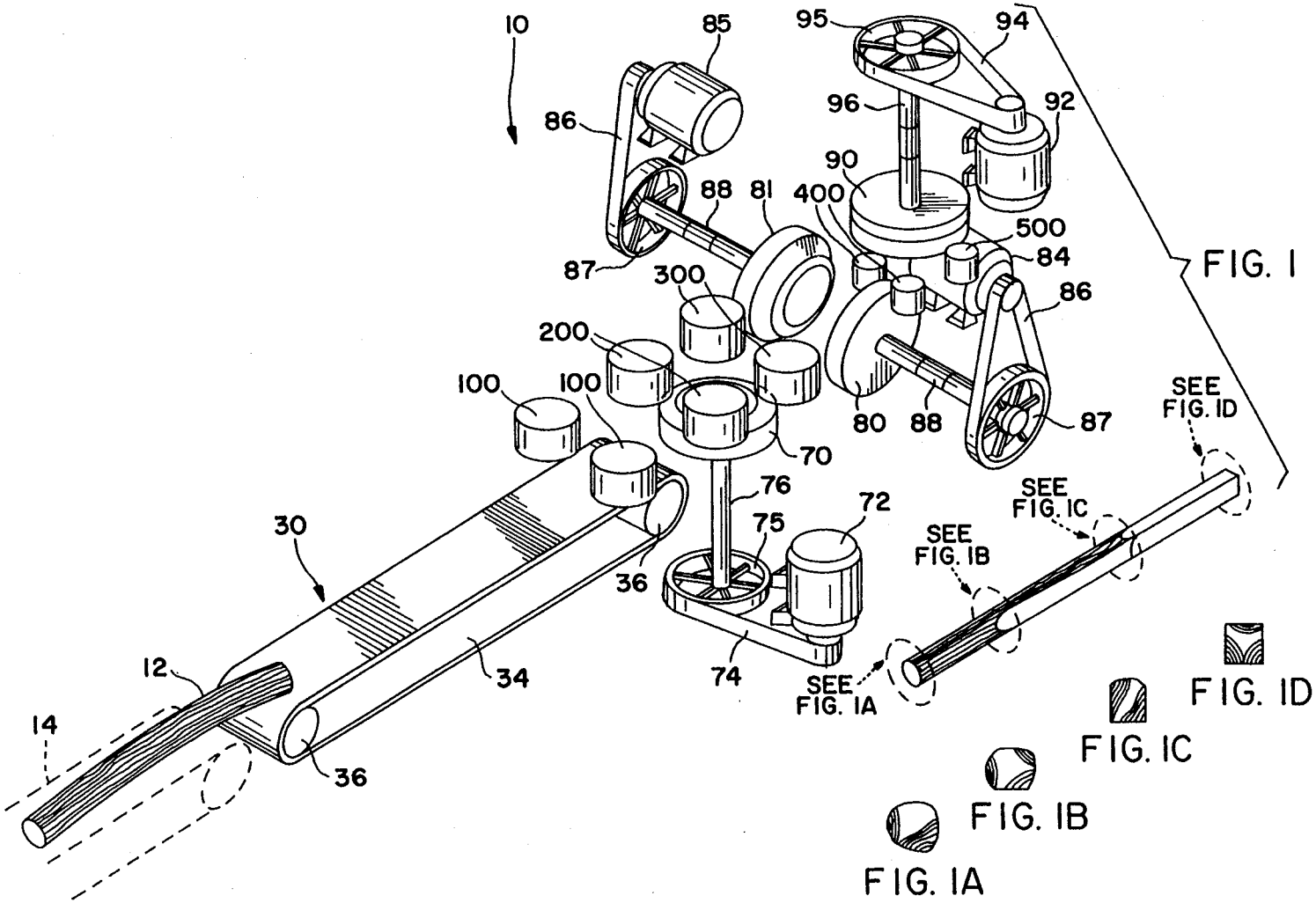
FIG. 1 is a simplified perspective view of the chipping canter according to the present invention.
FIGS. 1A, 1B, 1C and 1D are cross-sections of the log shown in FIG. 1.

Referring to FIG. 1, the chipping canter 10 is provided with logs 12 coming from an external loading means such as a flat feeding conveyor 14. The logs 12 which are to be processed in the chipping canter 10 are provided therein one by one. Each log 12, such as the one illustrated in FIG. 1, is substantially aligned with the longitudinal axis of the chipping canter 10. The log 12 is flatly disposed by gravity over the feeding conveyor 14 so that it positions itself thereon without any external positioning device. The log 12 is then forwarded to the entry of the chipping canter 10, the log deck 30.

Figure 3:
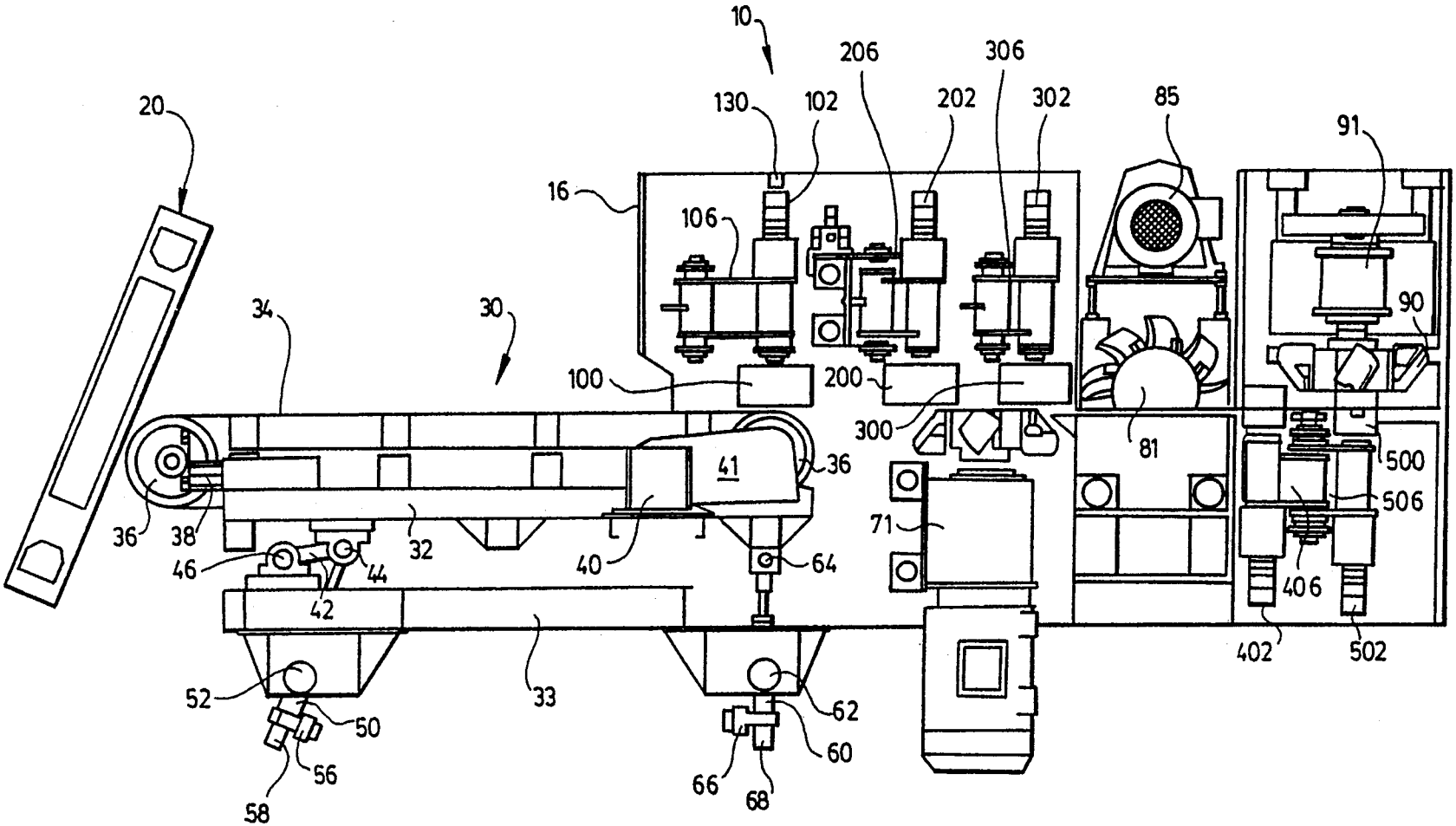
FIG. 3 is a side elevational view of the chipping canter of FIG. 2.

Referring to FIGS. 1 to 3, the log deck 30 is a flat conveyor having a belt 34, defining a supporting surface, winded around belt pulleys 36. The log deck 30 is also aligned with the longitudinal axis of the chipping canter 10. The tension in the belt 34 is adjustable by two belt tighteners 38, each provided on one side of the log deck 30 for moving one of the belt pulleys 36. A hydraulic motor 40, controlled by a hydraulic control valve 47 (FIG. 6) is used for driving the belt 34. The hydraulic motor 40 is mechanically connected to one of the belt pulleys 36 by means of a timing belt or chain (not shown) hidden behind a belt guard 41.

The log deck 30 is divided in a log deck upper frame 32 and a log deck lower frame 33. The log deck upper frame 32 bears the belt 34 and the related components, and is movable with respect to the lower frame 32 by means of an upstream hydraulic actuator 50 and a downstream hydraulic actuator 60. The upstream portion of the upper frame 32 is operatively attached to the lower frame 33 by means of a lever 42 connected to a first pivot 44 and a second pivot 46. The actuator 50 is operatively connected to the lower frame 33 by means of lower attachment pivot 52, and is operatively connected to the upper frame 32 on the first pivot 44. The actuator 60 is operatively connected to the lower frame 33 by means of a lower attachment pivot 62, and is operatively connected to the upper frame 32 by means of an upper attachment pivot 64. The actuators 50 and 60 are respectively controlled by hydraulic control valves 56 and 66, and comprise a position gauge, 58 and 68 respectively, for providing the exact orientation of the upper frame 32. With these two actuators 50 and 60, the upper frame 32 can be moved according to two degrees of freedom.

Figure 4:
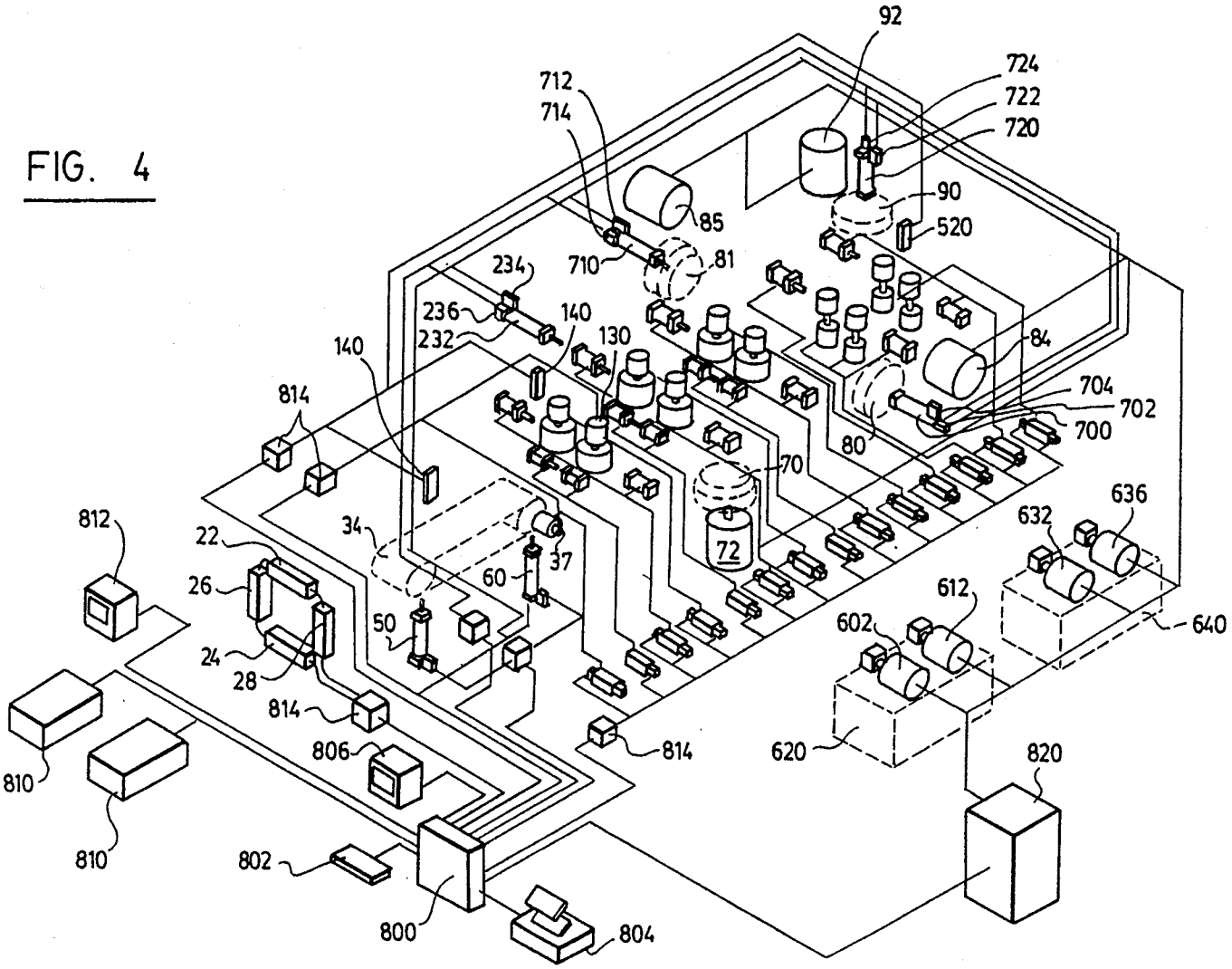
FIG. 4 is a schematic view of the main electric connections between components.

As shown in FIGS. 3 and 4, the log 12 undergoes a scanning procedure performed by an entry scanner assembly 20 while being forwarded to the log deck 30. The scanning is preferably done by four scanners: a horizontal upper scanner 22, a horizontal lower scanner 24, a vertical left scanner 26, and a vertical right scanner 28. The scanner assembly 20 produces signals indicative of the curvature and dimensions of the log 12.

Downstream the log deck 30 is located the main frame 16 of the chipping canter 10. The main frame 16 supports all the components beyond the entry. For producing a four-sided cant from the log 12, there are four slabbing head assemblies mounted on the main frame 16. Of course, there may be a different number of slabbing heads if more or less machined sides are required.

There are also positioning means that position and orient the log 12 for forcing it to move along a path which will maximize the cross-sectional area and the length thereof. This is substantially done by taking into account the natural curvature of the log 12. Once the log 12 is processed completely through the chipping canter 10, it can be either straightened and cut, or cut according to curved sawing techniques and then straightened.

Figure 6:
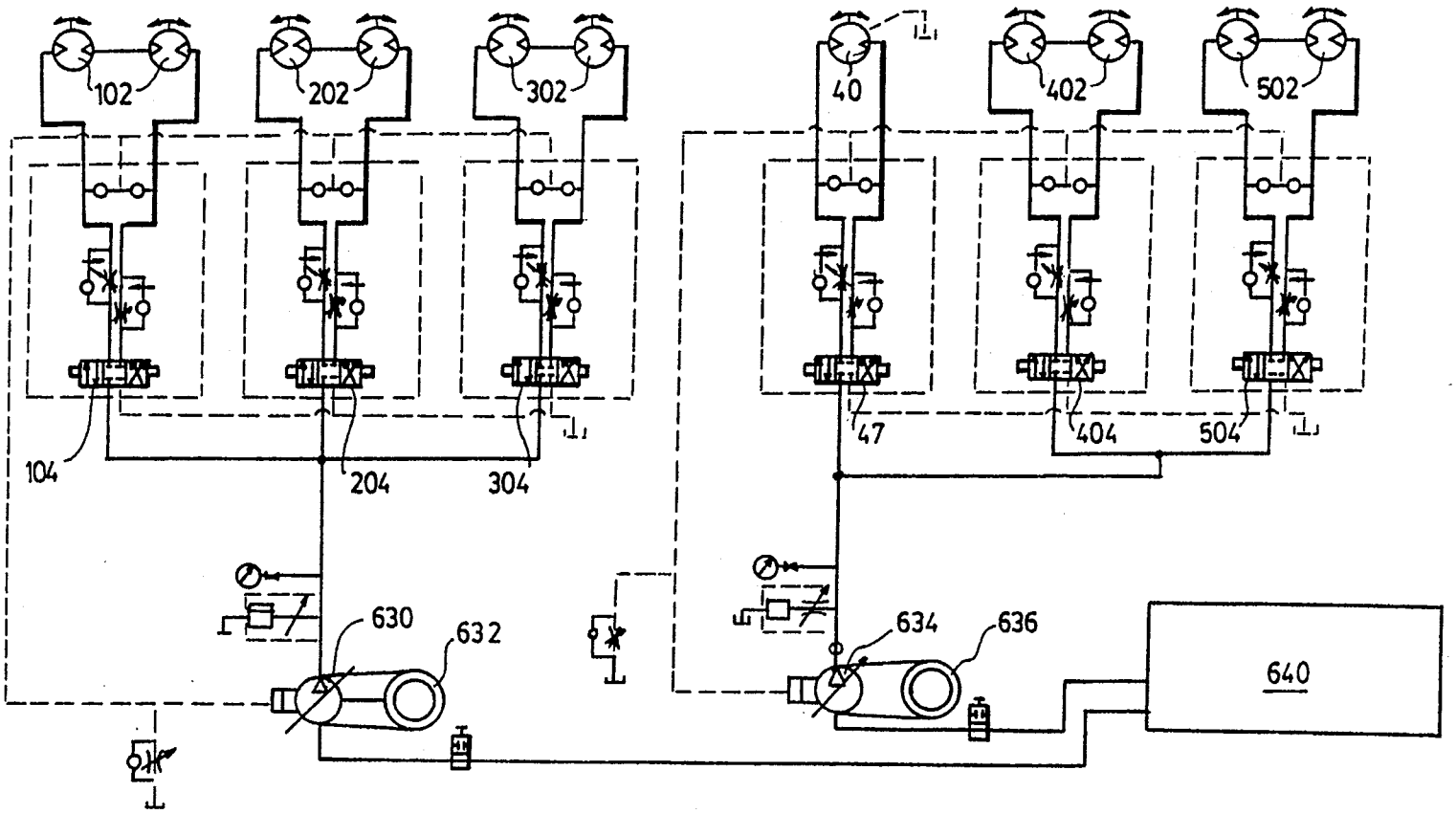
FIG. 6 is a diagram of the hydraulic connections of the hydraulic motors.

Referring to FIGS. 2 and 3, the first positioning means are located at the output end of the log deck 30. The first positioning means comprise two first centring rollers 100, one left and one right. Each centring roller 100 is located at the end of a corresponding pressing arm 106 and is preferably directly driven by a hydraulic motor 102 controlled by a hydraulic control valve 104 (FIG. 6). Each pressing arm 106 is operatively connected to the main frame 16 by means of a pivot allowing the centring rollers 100 to be moved in a plane parallel to the supporting surface, more particularly the horizontal plane. The centring rollers 100 preferably comprise a plurality of spikes radially projecting therefrom for providing a better grip on the log 12.

Figures 7A, 7B:
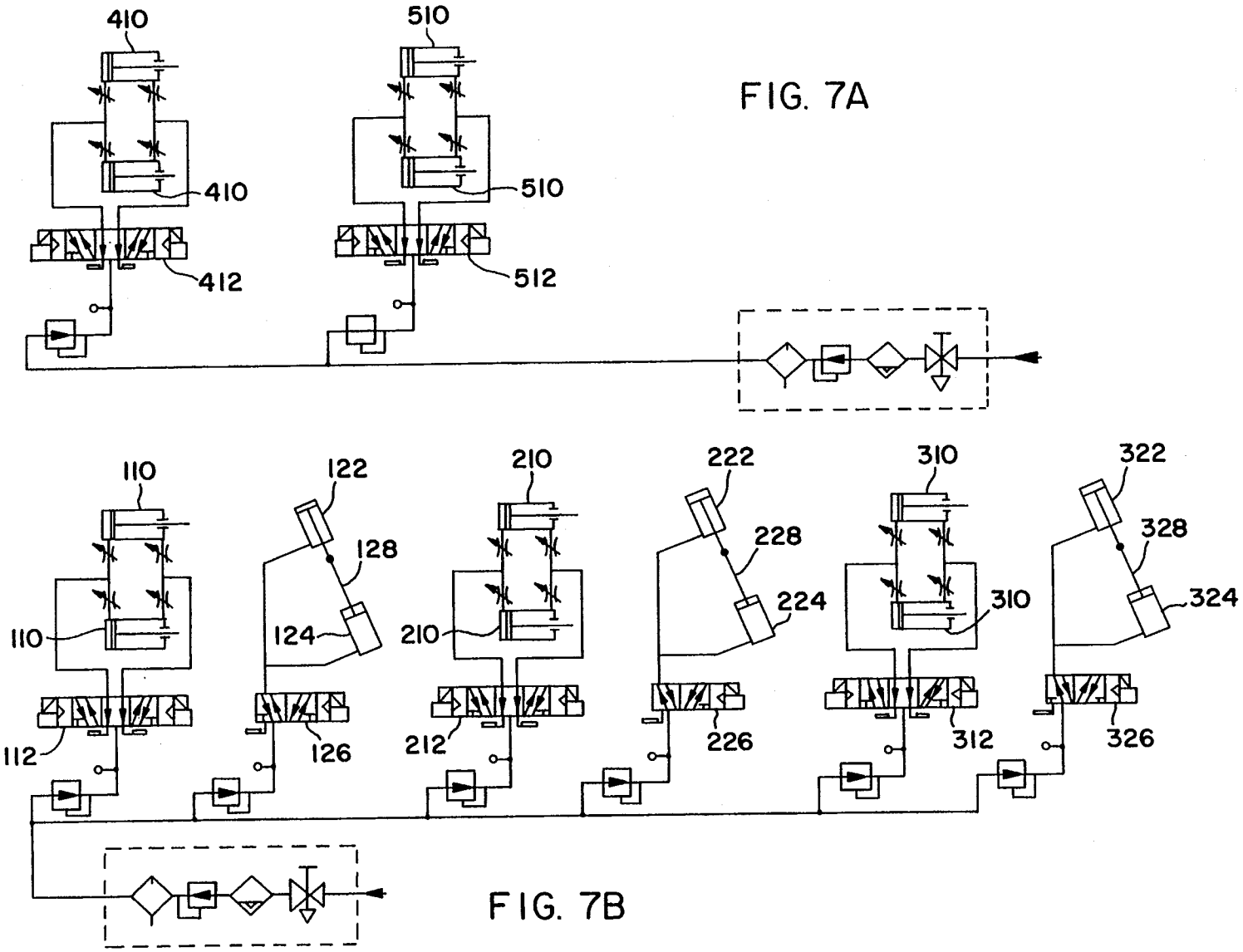
FIGS. 7A and 7B are diagrams of the pneumatic connections of the pneumatic actuators.

The centring rollers 100 can be moved towards or away from an incoming log 12 by means of two pneumatic actuators 110, each operating a corresponding pressing arm 106 and operatively attached to the main frame 16 by means of a pivot. The pneumatic actuators 110 are controlled by a pneumatic control valve 112 (FIG. 7).

Additionally, two pneumatic self-centring actuators 122 and 124 are provided for ensuring a symmetrical lateral displacement of both pressing arms 106 when that is requested. The left actuator 122 is operatively attached on a rearward extension 120 of the left pressing arm 106, while the right actuator 124 is operatively attached to the pressing arm 106 between the corresponding centring roller 100 and its pivot. A rod 128 links both actuators 122 and 124. The rod 128 is urged left upon application of pressurized air in the right parts of actuators 122 and 124. Pressurization of the actuators 122 and 124 will create a semi-rigid link that is also working as a damper for compensating the small irregularities of the log 12. When a log 12 goes between the two centring rollers 100, clearance for the log 12 is given by its forced passage between them and the actuators 110 will continue to apply a force on the pressing arms 106 for holding the log 12 firmly.

The second positioning means are located downstream the first positioning means and are very similar to them, except that they are mounted on a laterally movable carriage 230 operated by a hydraulic actuator 232. The carriage 230 is movable substantially perpendicularly to the longitudinal axis of the chipping canter 10. The actuator 232 is controlled by a hydraulic control valve 234 and has a position gauge 236 (FIG. 5) for knowing the exact position of the carriage 230.

The third positioning means are located downstream the second positioning means and are also very similar to the first positioning means. The third positioning means are directly fixed to the main frame 16.

Under the second and third positioning means is located a lower slabbing head assembly comprising a lower slabbing head 70, which is substantially horizontally disposed, for producing a lower machined side on the log 12. The lower slabbing head 70 is supported by a support 71. As shown in FIG. 1, the lower slabbing head 70 is driven into rotation by an electrical motor 72 linked to a shaft 76 by means of a belt 74 and a pulley 75.

Referring to FIGS. 2 and 3, there are further provided right lateral slabbing head assembly and left lateral slabbing head assembly, respectively comprising a right slabbing head 80 and a left slabbing head 81. Both are substantially vertically disposed and are movable substantially perpendicularly to the longitudinal axis of the chipping canter 10. The lateral slabbing heads 80 and 81 are respectively supported by movable supports 82 and 83. As shown in FIG. 1, the lateral slabbing heads 80 and 81 are respectively driven into rotation by electrical motors 84 and 85, linked to a corresponding telescopic shaft 88 by means of a belt 86 and a pulley 87.

Referring to FIGS. 2 and 3, there is further provided an upper slabbing head assembly comprising an upper slabbing head 90, which is substantially horizontally disposed, for producing an upper machined side on the log 12. The upper slabbing head 90 is supported by a support 91. As shown in FIG. 1, the upper slabbing head 90 is driven into rotation by an electrical motor 92 linked to a telescopic shaft 96 by means of a belt 94 and a pulley 95.

Fourth and fifth positioning means are located near the exit of the chipping canter 10, more particularly under the upper slabbing head 90. The fifth positioning means are located downstream the fourth positioning means. The fourth positioning means comprise two fourth centring rollers 400, one left and one right. Each centring roller 400 is located at the end of a corresponding pressing arm 406 and is preferably directly driven by a hydraulic motor 402 controlled by a hydraulic control valve 404 (FIG. 6). Each pressing arm 406 is operatively connected to the main frame 16 by means of a pivot, thereby allowing the centring rollers 100 to be moved in the horizontal plane. The centring rollers 400 also preferably comprise a plurality of spikes radially projecting therefrom. The centring rollers 400 can be moved towards or away from an incoming log 12 by means of two pneumatic actuators 410 controlled by the pneumatic control valve 412, each operating a corresponding pressing arm 406 and operatively attached to the main frame 16 by means of a pivot 414. The fourth centring rollers 400 are preferably always centred.

The fifth positioning means are substantially identical to the fourth ones. The pressing arm 506 is sharing the same pivot than the pressing arm 406. The fifth centring rollers 500 are not always centred.

Figure 8:
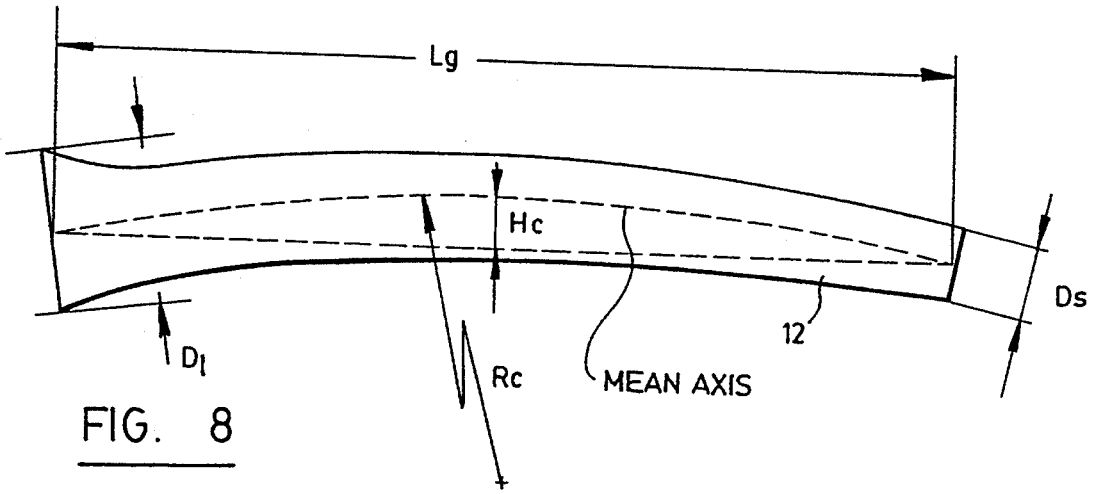
FIG. 8 is a schematic view showing some dimensions of a log.

As shown in FIG. 8, almost every log 12 is likely to have a curvature, negligible or important, which is the result of small curvatures of the log 12 along its length (Lg). The importance of the resultant curvature is evaluated by the radius of curvature (Rc). The maximum height (Hc) between the chord and the mean axis is dependant upon the radius and the length of the log 12. For simplifying the calculations, the maximum height (Hc) may be taken at mid-length of the log 12 (Lg/2).

In addition to the curvature, each log 12 has a slight conical shape since the diameter of the upper end of a tree, also called the diameter of the small end (Ds), is smaller than the diameter of the foot of the tree, also called the diameter of the large end (Dl). Since the maximum log recovering depends upon the maximization of the cross-sectional area and the length of the cant, the managers of the sawmill can choose to have longer cants with smaller cross-sectional areas, or to have shorter cants with larger cross-sectional areas. This is clearly visible in FIG. 9*a* where the dotted lines represent the cant that may be obtained after machining the log according to a maximization of the length. In general, cutting the log according to the small diameter of the upper end of the tree is believed to be more efficient than cutting the log according to the large diameter, which will inevitably lead to the discard of a portion of the small end which will be too small to be a part of the cant.

Figure 9A:
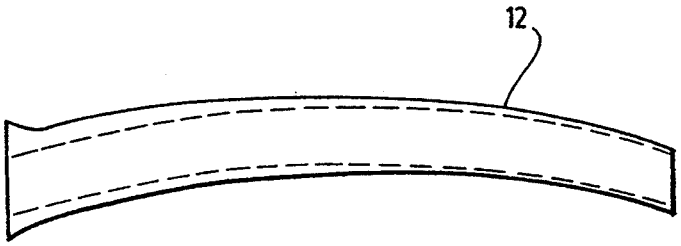

The present invention is very suitable for cutting logs similar to the one in FIG. 9*a*. The cutting is done following the mean axis, according to the radius of curvature, and by taking into account the diameter of the small end. However, the radius must remain in reasonable limits which depend on the design of the chipping canter 10. If the radius exceeds the maximum value, then the log 12 will be machined as a log having the maximum radius and the excess of wood will be simply machined off.

Figure 9B:
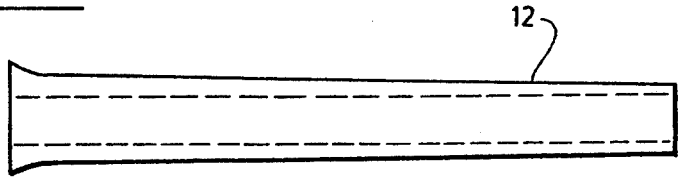
Figure 9C:
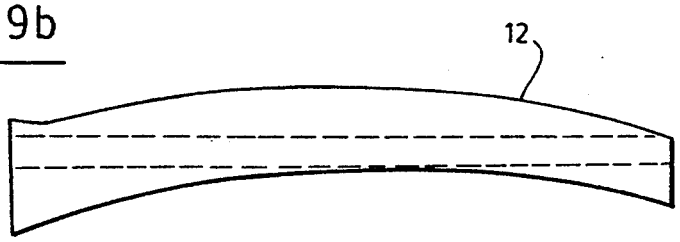
FIG. 9c PRIOR ART

The chipper canter 10 is also suitable for straight logs similar to the one shown in FIG. 9*b*. FIG. 9*c* shows an example of the cant that may be machined from a curved log when following the chord instead of the mean axis, as in the prior art. It is obvious that the cross-sectional area and the length of the cant of FIG. 9*c* are smaller than the ones of the cant of FIG. 9*a*.

The process begins like in FIG. 10 where the log 12 is laid on the feeding conveyor 14 by gravity and is driven forward between the entry scanner assembly 20 as the log 12 is sent to the log deck 30. The entry scanner assembly 20 sends signals indicative of the curvature and the dimensions of the log 12 to a computer 800 shown in FIG. 4.

Among the various information that is to be known by the computer 800, there is the position of the log 12. Knowing the actual position of the log 12 during the process is important because it allows the positioning means to be activated or disactivated at precise moments for improving the efficiency of the chipping canter 10. The position of the log 12 is calculated by means of an entry photodetector 69, a position encoder 37, an intermediary photodetector 140, a position encoder 130 and an exit photodetector 520.

As shown in FIG. 11, the scanning of the log 12 must be completed before the log 12 reaches the first photodetector 140. The log deck 30 is therefore longer than the log 12. As soon as the scanning of the log 12 is completed, the computer 800 calculates the position of the positioning components that the log 12 will encounter along its path.

Once the calculations are completed, the log deck 30 is positioned as to make the mean axis of the log 12 parallel to the longitudinal axis of the chipping canter 10. Since the longitudinal axis of the chipping canter 10 is generally horizontal, the mean axis of the log 12 will also be horizontal. It should be noted that the longitudinal axis of the chipping canter 10 is defined as a virtual central line extending from the entry to the exit thereof.

As shown in FIGS. 13 to 15, a good positioning of the log 12 is important for obtaining good results. In FIG. 13, the upstream end of the log deck 30 is too high and too much wood will be removed below the log 12. In FIG. 14, the mean axis is properly oriented. In FIG. 15, the upstream end of the log deck 30 is too low and not enough wood will be removed below the log 12.

As previously described, the log deck 30 is moved by means of an upstream hydraulic actuator 50 and a downstream hydraulic actuator 60. However, one of the actuators 50 and 60 is optional if the lower slabbing head 70 is movable. In the preferred embodiment, both actuators 50 and 60 are present and the lower slabbing head 70 is fixed.

The log deck 30 is moved very quickly because the log 12 has to be in position before it reaches the first centring rollers 100. Since the offset of the mean axis is not very important in terms of distance, the log deck 30 can usually be set very quickly.

FIGS. 16 to 28 show the step-by-step process of machining the log 12 from the log deck 30 to the exit of the chipping canter 10. The actuators are only shown therein when they are activated or disactivated.

In FIG. 16, the forward end of the log 12 reaches the location of the centring rollers 100. At that point, all the centring rollers 100, 200, 300, 400 and 500 are turning at a constant speed and no pneumatic actuators are pressurized. As the log 12 approaches the centring rollers 100, a signal is sent from the computer 800 to the pneumatic control valve 112 (FIG. 7) for ordering pressurization of the pneumatic actuators 110.

In FIG. 17, the forward end of the log 12 reaches an intermediate photodetector 140. If the computer 800 does not, for any reason, complete its calculation tasks before the log 12 goes in front of the intermediate photodetector 140, then the movement of the log 12 has to be slowed down or even stopped. Once the calculations are completed, the forwarding of the log 12 may be resumed. Unfortunately, due to the inertia of the log 12, the log 12 may slip during deceleration or acceleration of the belt 34. To recover the actual position of the log 12, the position encoder 130 may be used to reset the position of the log 12 for the computer 800. It should be pointed out that stopping or slowing down a log is very undesirable because it lowers the rate of production. The chipping canter 10 should be equipped with an entry scanning assembly 20 and a computer 800 capable of working at high speeds. The length of the log deck 30 may also be designed to have an optimum length.

When reaching the photodetector 140, the left and right self-centring actuators 122 and 124 are pressurized for providing self-centring capabilities to the first centring rollers 100. The actuators 122 and 124 are pressurized upon sending an appropriate signal to the pneumatic control valve 126 (FIG. 7). At that point, the forward end of the log 12 is fully held by the first centring rollers 100.

Because of the conical shape of the log 12, the downstream end of the log deck 30 is then lowered for preventing it from interfering with the normal operations of the centring rollers 100. However, the upstream end of the log deck 30 remains in position for supporting the rearward end of the log 12. If necessary, the downstream end of the log deck 30 may be progressively raised as the log 12 moves forward thereon in order to keep that end at a constant level.

In FIG. 18, the pneumatic actuators 210 and their left and right self-centring actuators 222 and 224 are pressurized as the forward end of the log 12 approaches the centring rollers 200. The actuators 222 and 224 are pressurized upon sending an appropriate signal to the pneumatic control valve 226 (FIG. 7). The sequence of closing the centring rollers 200 on the log 12 has to be completed before the log 12 reaches the lower slabbing head 70.

The laterally movable carriage 230, on which are located the slabbing heads 200, has been previously set to a proper position, preferably before the forward end of the log 12 goes between the centring rollers 100.

In FIG. 19, the log 12 is machined by the lower slabbing head 70.

In FIG. 20, the right and left lateral slabbing heads 80 and 81 are positioned at a location calculated by the computer 800. They are moved respectively by means of a right hydraulic actuator 700 and a left hydraulic actuator 710 located in their corresponding support 82 and 83. The slabbing heads 80 and 81 do not necessarily move symmetrically. Of course, they are moved before the forward end of the log 12 reaches the slabbing heads 80 and 81. As shown in FIG. 4, the hydraulic actuators 700 and 710 respectively have a position gauge 704 and 714 for providing an indication of the actual position of the corresponding slabbing head 80 or 81. The actuators 700 and 710 are also controlled respectively by hydraulic control valves 702 and 712 mounted on the corresponding actuator 700 or 710.

Simultaneously, the upper slabbing head 90 is positioned at a location calculated by the computer 800. It is moved by means of an upper hydraulic actuator 720 located in the support 91. As shown in FIG. 4, the hydraulic actuators 720 have a position gauge 724 for providing an indication of the actual position of the upper slabbing head 90. The actuator 720 is controlled by a hydraulic control valve 722 thereon.

In FIG. 21, the pneumatic actuators 310 and their left and right self-centring actuators 322 and 324 are pressurized as the forward end of the log 12 approaches the third centring rollers 300. The actuators 322 and 324 are pressurized upon sending an appropriate signal to the pneumatic control valve 326 (FIG. 7). The sequence of closing the centring rollers 300 on the log 12 has to be completed before the log 12 reaches the lateral slabbing heads 80 and 81.

In FIG. 22, the pneumatic actuators 110 are not pressurized for not interfering with the log 12. This is done by sending an appropriate signal to the pneumatic control valve 126 after or simultaneously to the pressurization of the pneumatic actuators 310. The pneumatic actuators 110 will remain at their last location unless moved by the log 12 or if desired by the operator.

In FIG. 23, the rearward end of the log 12 is displaced when the forward end of the log 12 is held by the centring rollers 300. This should not affect the machining by the lower slabbing head 70.

In FIG. 24, the pneumatic actuators 410 are pressurized as the forward end of the log 12 approaches the centring rollers 400. The actuators 422 and 424 are pressurized upon sending an appropriate signal to the pneumatic control valve 426 (FIG. 7). The sequence of closing the centring rollers 400 on the log 12 has to be completed before the log 12 reaches the upper slabbing head 90.

In FIG. 25, the left and right pneumatic self-centring actuators 322 and 324 are not pressurized after pressurization of the pneumatic actuators 410. The centring rollers 400 are always self-centred.

In FIG. 26, the pneumatic actuators 510 are pressurized as the forward end of the log 12 approaches the centring rollers 500. The centring rollers 500 are not self-centred.

In FIG. 27, the pneumatic actuators 310 and their left and right self-centring actuators 322 and 324 are not pressurized as the forward end of the log 12 goes between the centring rollers 500.

Once the machining is over, the resulting cant is moved away from the chipping canter 10 by an exit conveyor 18.

For optimizing the rate of production, each log 12 may be very close to the preceding one. Enough space is however required for allowing the movable components to be set to another position. This also depends on the speed of the logs. Typical speed for displacement of the logs is 8 in. per second.

Figure 5:
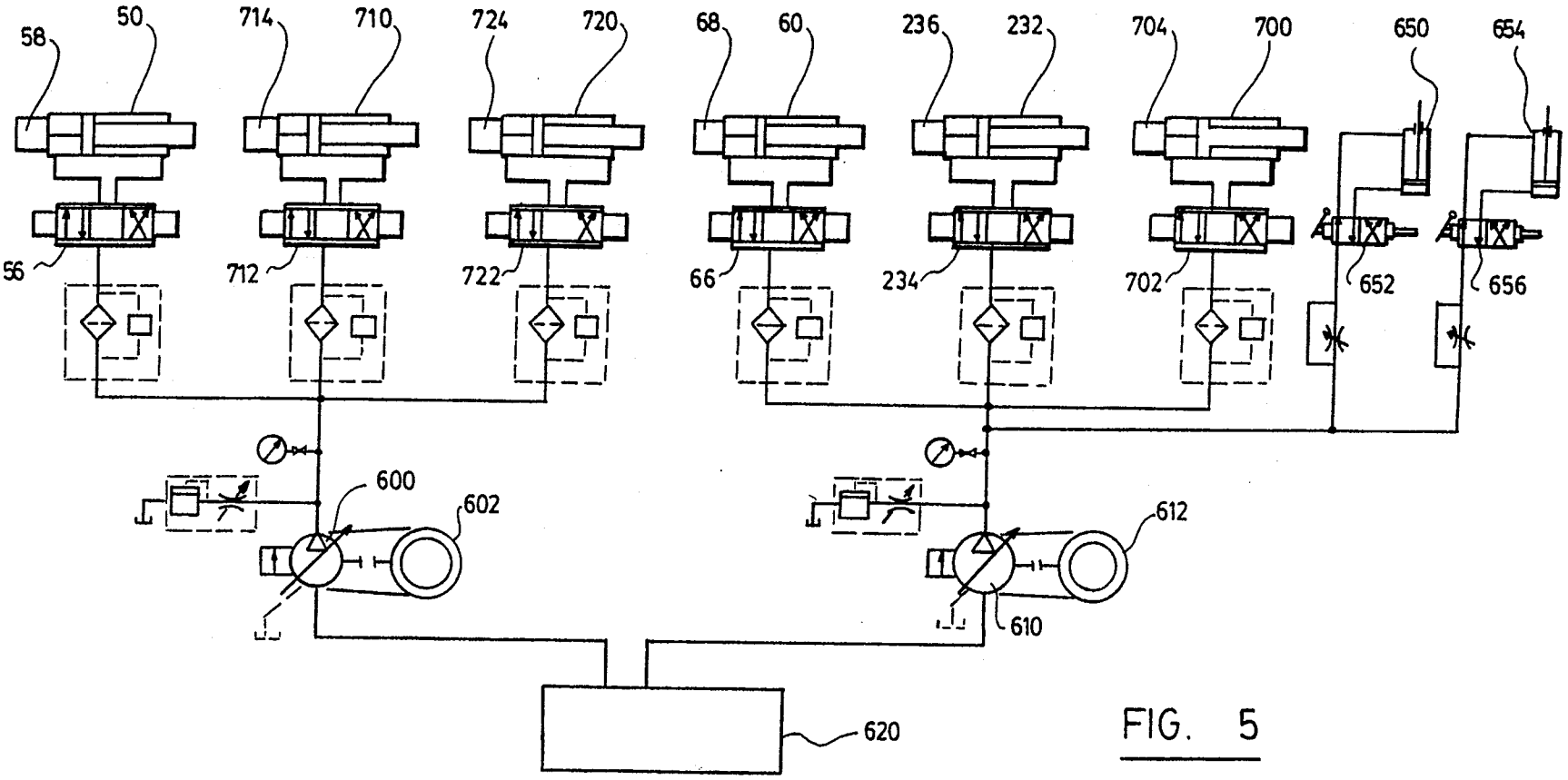
FIG. 5 is a diagram of the hydraulic connections of the hydraulic actuators.

In FIG. 5, there is shown a diagram of the hydraulic connections of the hydraulic actuators. Each actuator is controlled by a corresponding hydraulic control valve. In the preferred embodiment, the hydraulic actuators are divided in two groups, each having its own pump and motor. The first group has a pump 600 driven by an electric motor 602. The second group has a pump 610 driven by an electrical motor 612. Both groups share the same hydraulic fluid tank 620. Other usual components, such as manometers, filters, etc., are found on the hydraulic actuator circuits.

The chipping canter 10 may further comprise a first and a second hydraulic actuator, respectively numbered 650 and 654, which may be activated by a corresponding manual hydraulic control valve 652 or 656. The actuators 650 and 654 are used for lifting the upper slabbing head 90 during maintenance.

In FIG. 6, there is shown a diagram of the hydraulic connections of the hydraulic motors. The motors are mounted in pairs, each pair having a corresponding hydraulic control valve. In the preferred embodiment, the hydraulic motors are divided in two groups, each having its own pump and motor. The first group has a pump 630 driven by an electric motor 632. The second group has a pump 634 driven by an electrical motor 636. Both groups share the same hydraulic fluid tank 640.

In FIG. 7, there is shown a diagram of the pneumatic connections of the pneumatic actuators. Each actuator is controlled by a corresponding pneumatic control valve. In the preferred embodiment, the pneumatic actuators are divided in two groups, each group having its own external pressurized air supply.

CALCULATIONS

As aforesaid, the computer 800 is calculating the position of the movable elements from the information sent by the entry scanner assembly 20. The following information is provided once the scanning is completed:

Length of the log (Lg);

Diameter of the small end (Ds);

Diameter of the large end (Dl);

Radius of curvature (Rc) or height of curvature (Hc).

The following is a list, in alphabetical order, of the variables in the equations:

| | |
|---|---|
| α | Angle of conicity of the log (degree); |
| C1 | Constant equal to the distance between the actual and the final position of the downstream end of the log deck 30; |
| C2 | Constant equal to the distance between the actual and the final position of the upstream end of the log deck 30; |
| C4 | Constant equal to the half of the distance between the center of a third centring roller 300 and the center of a fourth centring roller 400 on the same side (FIG. 29); |
| C5 | Constant equal to the distance between the half of the distance between the third centring rollers 300 and the fourth centring rollers 400, and the center of the second centring rollers 200; |
| C6 | Constant equal to the distance between the half of the distance between the third centring rollers 300 and the fourth centring rollers 400, and the leading edge of the lateral slabbing heads 80 and 81; |
| C7, C8, C9, Cx | Constants of distance; |
| C | cut; |
| Dc | Depth of cut of the slabbing heads; |
| Dcm | Maximum depth of cut of the slabbing heads; |
| Dl | Diameter of the large end of the log 12; |
| Dlsh | Diameter of the lateral slabbing heads 80 and 81; |
| Dush | Diameter of the upper slabbing head 90; |
| Ds | Diameter of the small end of the log 12; |
| DP1 | Displacement of the upstream hydraulic actuator 50; |
| DP2a | Displacement of the downstream hydraulic actuator 60; |
| DP2b | Second displacement of the downstream hydraulic actuator 60; |
| DP3 | Displacement of the hydraulic actuator 232; |
| DP4 | Displacement of the right hydraulic actuator 700; |
| DP5 | Displacement of the left hydraulic actuator 710; |
| DP6 | Displacement of the upper hydraulic actuator 720; |
| E | Gap between successive logs; |
| Hc | Height of the curvature at Lg/2; |
| Hf | Height of the cant after curved machining; |
| Hf' | Height of the cant after straight machining; |
| Lg | Length of the log; |
| Oc | Orientation of the curvature of the log; |
| Oc' | Orientation of the curvature of the previous log; |
| P1 | Final position of the upstream hydraulic actuator 50; |
| P2a | Final position of the downstream hydraulic actuator 60; |
| P2b | Horizontal position of the downstream hydraulic actuator 60; |
| P3 | Final position of the hydraulic actuator 232; |
| P4 | Final position of the right hydraulic actuator 700; |
| P5 | Final position of the left hydraulic actuator 710; |
| P6 | Final position of the upper hydraulic actuator 720; |
| P1' | Previous position of upstream hydraulic actuator 50; |
| P2a' | Previous position of the downstream hydraulic actuator 60; |
| P2b' | Horizontal position of the downstream hydraulic |

-continued

| | |
|---|---|
| | actuator 60; |
| P3' | Previous position of the hydraulic actuator 232; |
| P4' | Previous position of the right hydraulic actuator 700; |
| P5' | Previous position of the left hydraulic actuator 710; |
| P6' | Previous position of the upper hydraulic actuator 720; |
| Rc | Radius of curvature; |
| T1, . . . , T6 | Time required for DP1, etc.; |
| TA1, . . . T6 | Available time for DP1, etc.; |
| Tr1, . . . Tr6 | Time of reaction of the hydraulic actuators; |
| V Va1, . . . | Velocity of the logs; |
| Va6 | Velocity of the hydraulic actuators; |
| Wf | Width of the cant. |

Note: R_ are reported results in the calculations.

The diameter of the small end (Ds) allows calculation of Hf and the Wf of the finished product according to the information stored in a slabbing pattern definition table located in the memory of the computer 800.

The conicity is calculated according to the maximum Dl for avoiding an overload of the lower slabbing head 70.

Equation 1: $Dl\ \text{max.} = Hf + (Dcm * 2)$

Equation 2: $\text{Tan}\ \alpha = \dfrac{(\min(Dl\ \text{or}\ Dl\ \text{max.}) - Dl)}{(lg * 2)}$ Equation 3: $Rc = \dfrac{Lg^2 + (4 * Hc^2)}{(8 * Hc)}$ Equation 4: $Hc = Rc - \dfrac{\sqrt{((4 * Rc^2) - Lg^2)}}{2}$ Once the conicity is known, the positioning of the log deck 30 is calculated as follow:

Equation 5: $C = \dfrac{Dl - Hf}{2}$

Equation 6: $P1 = C + (C2 * \text{Tan}\ \alpha)$

Equation 7: $P2a = P1 - (2 * (C2 - C1) * \text{Sin}(\alpha/2))$

Equation 8: $P2b = P1$

Note: $0 \leqq P1 \leqq Dc$ and $0 \leqq P2a \leqq Dc$

The position of the laterally movable carriage 230 and the lateral slabbing heads 80 and 81 are then calculated.

Equation 9:

$R1 = Rc - \sqrt{(Rc^2 - C4^2)}$

Equation 10:

$R2 = Rc - \sqrt{(Rc^2 - C5^2)}$

Equation 11:

$R4 = Rc - \sqrt{(Rc^2 - C6^2)}$

Equation 12:

$P3 = R2 - R1$

| | |
|---|---|
| Note: | if Oc is right, then P3 is positive<br>if Oc is left, then P3 is negative |

Equation 13:

if Oc=right, then P4=(Wf/2)+(R2-R4)

if Oc=left, then P4=(Wf/2)−(R2-R4)

Equation 14:

if Oc=right, then P5=(Wf/2)−(R2-R4)

if Oc=left, then P5=(Wf/2)+(R2-R4)

Equation 15:

P6=Hf

The displacement is then calculated.

Equation 16:

DP1=Abs(P1'—P1)

Equation 17:

DP2a=Abs(P2a'—P2a)

Equation 18:

DP2b=Abs(P2a—P1)

Equation 19:

if Oc'=right and Oc=right, then DP3=Abs(P-3'—P3)

if Oc'=right and Oc=left, then DP3=P3'+P3 if Oc'=left and Oc=right, then DP3=P3+P3 if Oc'=left and Oc=left, then DP3=Abs(P3'—P3)

Equation 20:

if Oc'=right and Oc=right, then DP4=Abs(P-4'—P4)

if Oc'=right and Oc=left, then DP4=P4'+P4 if Oc'=left and Oc=right, then DP4=P4'+P4 if Oc'=left and Oc=left, then DP4=Abs(P4'—P4)

Equation 21:

if Oc'=right and Oc=right, then DP5=Abs(P-5'—P5)

if Oc'=right and Oc=left, then DP5=P5'+P5 if Oc'=left and Oc=right, then DP5=P5'+P5 if Oc'=left and Oc=left, then DP5=Abs(P5'—P5)

Equation 22:

DP6=Abs(P6'—P6)

It is important that the time required for a displacement be less than the available time. If not, the velocity of the logs have to be reduced or even stopped.

Equation 24: $TA1 = \dfrac{E - C7}{V}$

Equation 25: $T1 = \dfrac{DP1}{Va1} + Tr1$ if $T1 < (Tr1 * 2)$, then $T1 = \sqrt{\left(\dfrac{(DP1 * 4 * Tr1)}{Va1}\right)}$ Equation 26: $TA2a = \dfrac{E - C7}{V}$ Equation 27: $T2a = \dfrac{DP2a}{Va2} + Tr2a$ if $T2a < (Tr2a * 2)$, then $T2a = \sqrt{\left(\dfrac{(DP2a * 4 * Tr2a)}{Va2}\right)}$ Equation 28: $TA2b = \dfrac{C8}{V}$ Equation 29: $T2b = \dfrac{DP2b}{Vb2} + Tr2b$ if $T2b < (Tr2b * 2)$, then $T2b = \sqrt{\left(\dfrac{(DP2b * 4 * Tr2b)}{Vb2}\right)}$ Equation 30: $TA3 = \dfrac{E + C9}{V}$ -continued Equation 31: $T3 = \frac{DP3}{Vb3} + Tr3$ if $T3 < (Tr3 * 2)$, then $T3 = \sqrt{\left(\frac{(DP3 * 4 * Tr3)}{Vb3}\right)}$ Equation 32: $TA4 = \frac{E - Dlsh}{V}$ Equation 33: $T4 = \frac{DP4}{Va4} + Tr4$ if $T4 < (Tr4 * 2)$, then $T4 = \sqrt{\left(\frac{(DP4 * 4 * Tr4)}{Vb4}\right)}$ Equation 34: $TA5 = \frac{E - Dlsh}{V}$ Equation 35: $T5 = \frac{DP5}{Va5} + Tr5$ if $T5 < (Tr5 * 2)$, then $T5 = \sqrt{\left(\frac{(DP5 * 4 * Tr5)}{Vb5}\right)}$ Equation 36: $TA6 = \frac{E - Dush}{V}$ Equation 37: $T6 = \frac{DP6}{Va6} + Tr6$ if $T6 < (Tr6 * 2)$, then $T6 = \sqrt{\left(\frac{(DP6 * 4 * Tr6)}{Vb6}\right)}$

CONCLUSION

The above-described chipping canter is thus very suitable for machining curved logs while maximizing the cross-sectional area and length.

Although a preferred embodiment of the invention has been described in detail herein and illustrated in the accompanying drawings, it is to be understood that the invention is not limited to this precise embodiment and that many changes and modifications may be effected therein without departing from the scope or spirit of the invention.

We claim:

1. A chipping canter for producing a four-sided cant from a log having a curvature, said chipping canter having an entry and an exit between which is defined a log path, said chipping canter comprising:

driving means for forwarding said log along the log path;

conveyor means having a supporting surface for supporting said log set thereon, said supporting surface having an input end and an output end, said conveyor means being located at the entry of said chipping canter and comprising first displacement means for vertically moving at least one of said ends;

scanning means located at the input end of said supporting surface for producing first signals indicative of the curvature and dimensions of said log;

first positioning means adjacent said output end of said supporting surface;

second positioning means located downstream said first positioning means and movable substantially laterally with respect to a longitudinal axis of said chipping canter by second displacement means;

a first slabbing head assembly for producing a first machined side, said first slabbing head assembly comprising a first slabbing head substantially horizontally disposed;

third positioning means located downstream said second positioning means;

a second slabbing head assembly for producing a second machined side, said second slabbing head assembly comprising a second slabbing head substantially vertically disposed and movable substantially perpendicularly with respect to the longitudinal axis of said chipping canter by third displacement means, said second slabbing head being located downstream said third positioning means;

a third slabbing head assembly for producing a third machined side opposite said second machined side, said third slabbing head assembly comprising a third slabbing head substantially vertically disposed and movable substantially perpendicularly with respect to the longitudinal axis of said chipping canter by fourth displacement means, said third slabbing head being located downstream said third positioning means;

a fourth slabbing head assembly for producing a second substantially horizontal machined side opposite said first machined side, said fourth slabbing head assembly comprising a fourth slabbing head substantially horizontally disposed;

fourth positioning means adjacent to the exit;

fifth positioning means located downstream said fourth positioning means; and computer means for receiving said first signals from said scanning means and producing second signals for controlling said driving means, said displacement means and said positioning means;

whereby, as said log is forwarded along the log path, said conveyor means and said positioning means are properly aligning said log with respect to said slabbing heads.

2. A chipping canter according to claim 1, wherein said fourth slabbing head is movable substantially perpendicularly with respect to the longitudinal axis of said chipping canter by fifth displacement means.

3. A chipping canter according to claim 1, wherein said first displacement means comprise actuators for moving independently each of said ends of said conveyor means.

4. A chipping canter according to claim 1, wherein said second and third slabbing heads are substantially coaxial.

5. A chipping canter according to claim 1, wherein said signals produced by said computer means are sent to said second displacement means before said log is detected by first sensing means adjacent said first positioning means.

6. A chipping canter according to claim 1, wherein said first sensing means is a photodetector.

7. A chipping canter according to claim 1, wherein each of said positioning means comprises two centring rollers pneumatically actuated, each roller comprising a plurality of spikes radially projecting therefrom.

8. A chipping canter according to claim 7, wherein each of said positioning means comprises centring means for symmetrically moving each of said corresponding two centring rollers about the log path.

9. A chipping canter according to claim 7, wherein said supporting surface is a belt, said driving means comprising a hydraulic motor for driving said belt and a plurality of hydraulic motors for driving said centring rollers.

10. A chipping canter according to claim 1, wherein said second displacement means comprise a carriage hydraulically actuated.

11. A method for operating a chipping canter for producing a four-sided cant from a log having curvature, said chipping canter having an entry and an exit between which is defined a log path along which said log is forwarded, said method comprising the steps of:

disposing said log on a supporting surface of conveyor means, said supporting surface having an input end and an output end, said conveyor means being located at the entry of said chipping canter and comprising first displacement means for vertically moving at least one of said ends;

scanning said log with scanning means located at the input end of said supporting surface for producing first signals indicative of the curvature and dimensions of said log;

receiving said first signals and producing second signals with computer means;

vertically moving at least one of said ends of said conveyor means according to said second signals;

positioning said log with first positioning means adjacent said output end of said supporting surface;

positioning said log with second positioning means located downstream said first positioning means and movable substantially perpendicularly with respect to a longitudinal axis of said chipping canter by second displacement means responsive to said second signals;

producing a first machined side with a first slabbing head assembly, said first slabbing head assembly comprising a first slabbing head substantially horizontally disposed;

positioning said log with third positioning means located downstream said second positioning means;

producing a second machined side with a second slabbing head assembly, said second slabbing head assembly comprising a second slabbing head substantially vertically disposed and movable substantially perpendicularly with respect to the longitudinal axis of said chipping canter by third displacement means responsive to said second signals, said second slabbing head being located downstream said third positioning means;

producing a third machined side opposite said second machined side with a third slabbing head assembly, said third slabbing head assembly comprising a third slabbing head substantially vertically disposed and movable substantially perpendicularly with respect to the longitudinal axis of said chipping canter by fourth displacement means, said third slabbing head being located downstream said third positioning means responsive to said second signals;

producing a second substantially horizontal machined side opposite said first machined side with a fourth slabbing head assembly, said fourth slabbing head assembly comprising a fourth slabbing head substantially horizontally disposed;

positioning said log with fourth positioning means adjacent the exit;

positioning said log with fifth positioning means located downstream said fourth positioning means;

whereby, as said log is forwarded along the log path, said positioning means are properly aligning said log with respect to said slabbing heads.

* * * * *